US005247887A

United States Patent [19]

Drimmer

[11] Patent Number: 5,247,887

[45] Date of Patent: Sep. 28, 1993

[54] DYNAMIC METHOD FOR ENHANCING EFFECTS OF UNDERWATER EXPLOSIONS

[75] Inventor: Bernard E. Drimmer, Arlington, Va.

[73] Assignee: The United States of America as represented by the Secretary of the Navy, Washington, D.C.

[21] Appl. No.: 484,507

[22] Filed: Jun. 27, 1974

[51] Int. Cl.[5] ..... F42B 15/20; F42B 12/16

[52] U.S. Cl. ..... 102/399; 102/308; 102/476; 114/20.1

[58] Field of Search ..... 102/24 HC, 54, 56 SC, 102/308, 309, 310, 399, 476; 114/20.1

[56] References Cited

U.S. PATENT DOCUMENTS 3,109,373 11/1963 Saffer, Jr. ..... 102/24 HC 3,129,665 4/1964 Evans, Jr. ..... 102/56 SC 3,215,074 11/1965 Robinson, Jr. et al. ..... 102/24 HC

FOREIGN PATENT DOCUMENTS 545871 3/1956 Belgium ..... 102/56 SC

*Primary Examiner*—Harold J. Tudor

*Attorney, Agent, or Firm*—Thomas E. McDonnell

[57] ABSTRACT

An explosive charge for underwater use comprising a shaped charge behind a main charge. The shaped charge is detonated, propelling a jet from the liner of the shaped charge through a tube extending through the main charge. When the jet passes through the water, it creates a cavity behind it. The main charge is detonated after a delay sufficient to allow the explosive energy to enter the cavity before the cavity begins to collapse.

4 Claims, 1 Drawing Sheet

DYNAMIC METHOD FOR ENHANCING EFFECTS OF UNDERWATER EXPLOSIONS

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

This invention relates to underwater explosions and especially to means for enhancing the effect of an underwater explosion.

In an underwater explosion, such as that produced by the warhead of a torpedo, the shockwave energy is distributed in the water essentially uniformly in all directions. If an air cavity in the water, whose volume is roughly equal to, or somewhat larger than, that of the explosive charge, can be placed adjacent to the charge, and between the explosive and the object to be destroyed, the distribution of shockwave energy will be modified so as to increase the amount of energy projected toward the object, with resultant increased damage to the object.

Accordingly it is an object of this invention to produce a cavity in the water, between the main explosive charge and a target, immediately prior to the detonation of the main explosive charge, and have the main charge detonate before the cavity has time to collapse. In this fashion more of the explosive energy is projected toward a target, increasing damage in the target.

Another object is to enhance the effect of an underwater explosion in a preferred direction.

Other objects, advantages, and novel features of the present invention will become apparent from the following detailed description of the invention A%,hen considered in conjunction with the accompanying drawings.

SUMMARY OF THE INVENTION

The objects and advantages of the present invention are accomplished by utilizing a cavity in the water to more favorably direct energy from an underwater explosion to a target. This is accomplished by placing a shaped charge behind a main charge which is hollowed out to permit the jet from the shaped-charge liner to pass through the main charge into the water toward the target of the explosion. The main charge is detonated after a delay which allows the jet time to create a cavity in the water through which an increased amount of explosive energy from the main charge is directed toward the target.

DETAILED DESCRIPTION OF THE INVENTION

Figure 1:
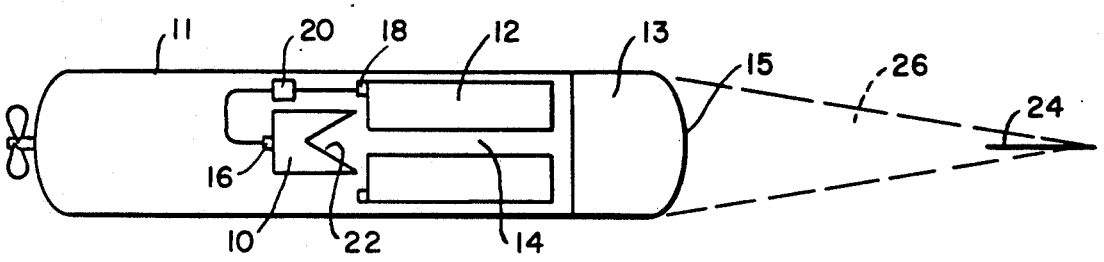
FIG. 1 is an embodiment of the invention in which two spaced charges are used inside of a torpedo casing.

As shown in FIG. 1, a main charge 12, having a hollowed portion 14 from its front side to its rear side, is placed within a torpedo casing 11 near the front compartment 13. (A torpedo is used by way of illustration since it is expected that this invention will find its primary, although not exclusive, use in torpedoes). For a cylindrical main charge as shown, the hollowed-out portion would be a tube having the same axis as the charge. In any case, the hollow must be able to accommodate a straight line from one side of the charge to the other.

A shaped charge 10 having a conical liner 22 is placed behind the main charge so that the apex of the liner lies on the axis through the tube 14, i.e., the axis bisects the apex angle.

Detonation-and-delay means 20 is connected to a detonator 16 at the rear of the shaped charge 10 and to a ring detonator 18 at the rear of the main charge 12.

At the proper time (for example, when torpedo nose hits a target), the detonation-and-delay means applies an impulse to the shaped-charge detonator 16 which explodes the shaped charge. This explosion causes the liner 22 to form a jet 24 which is propelled through the tube 14, through the forward compartment 13 and whatever is in it, and through the torpedo nose 15. When the jet 24 passes through the water toward the target, it forms a cavity 26 behind it. The jet 24 also increases in length as it travels.

It is desirable in terms of target penetration to permit the jet enough time to make as big a cavity in the water as is feasible and convenient. However, too long a delay before initiation of the main charge detonation will allow the cavity to bean to collapse. Therefore, the detonation-and-delay means 20 is set to provide a delay, before providing the impulse to initiate detonation of the main charge 12, which will permit the jet 24 to form as large a cavity as possible but not sufficient to permit the cavity 26 to begin to collapse. The amount of delay depends on the particular parameters of the torpedo and the charges in any specific case, like the speed of the jet (which can be increased somewhat by sharpening the apex angle), density of the liner material, distance between the shaped charge and the main charge, etc. The delay is typically of the order of several microseconds or milliseconds.

If the proper delay is used, extra quantities of explosive energy from the detonation of the main charge propagate through the cavity 26 following the jet 24 to the target. Since extra explosive energy is expended toward the target in the direction of the cavity area, the effect of the explosion on the target is enhanced. This result stems from the discovery that, if a properly shaped hollow space is placed next to a totally submerged explosive charge, the distribution of shock energy in the water which would occur in the absence of the hollow space is changed so as to increase the amount of energy in the direction of the hollow space. Incorporation of a hollow space into an ordnance item is not considered space-effective or even practical. The shaped charge required to form the desired hollow space in the water requires a very small amount of ordnance space as compared to other means for accomplishing the same end result. Thus, the function of the shaped charge in the present invention is not to produce direct damage to a target, as is its usual function, but to form an energy-redistributing hollow space in an underwater explosion.

Figure 2:
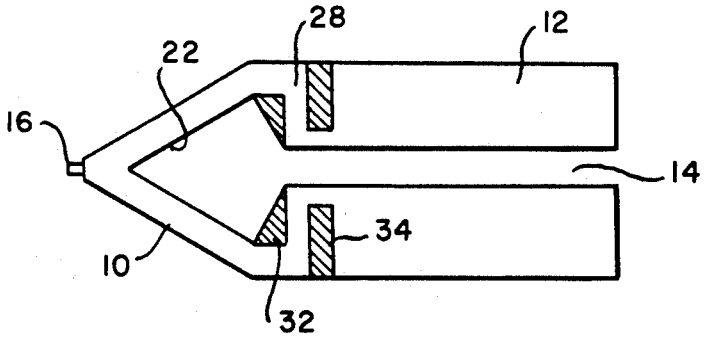
FIG. 2 is another embodiment of the invention in which the shaped and main charges are separated only by a pathway of explosive which provides the delay between the detonations.

In the second embodiment shown in FIG. 2, the shaped charge 10 forms an integral unit with the main charge 12, being separated from it only by a pathway 28 of explosive. The shape of the pathway 28 is defined by inert material such as Plaster of Paris, or wood, for example, which, in this case takes the form of a pair of spaced rings, or doughnuts, 32 and 34. The inert material forces the burning of the explosive to take place along a pathway which has sufficient length to provide the necessary delay before detonation of the main charge 12 takes place. If more delay is required, more rings may be used.

The operation is as before. An impulse is provided in any convenient manner to the detonator 16, exploding the shaped charge and forming a jet which travels through the tube 14 and into the water (through the torpedo compartment and the nose of the torpedo if the charge is in a torpedo). The jet 24 forms the cavity 26 and, after a proper delay provided by the pathway 28, the main charge 12 is detonated.

Obviously, many modifications and variations of the present invention are possible in light of the above teachings. It is therefore to be understood that, within the scope of the appended claims, the invention may be practiced otherwise than as specifically described.

What is claimed is:

1. An explosive charge which enhances the effect of an underwater explosion comprising, in combination:

a main explosive charge having a hollow area extending completely therethrough, said hollow area being configured so that a straight line could be drawn therethrough, said hollow area being configured so that a straight line cold be drawn therethrough from one side of the main charge to the opposite side;

means for forming a cavity through the water through which said main explosive can be propagated so that an increased amount of explosive energy is directed at a target, said forming means comprising:

a shaped explosive charge located to the rear of said main charge and having a conical liner, the apex of said liner lying on said straight line through said hollow area so that, when said shaped charge is detonated, the jet formed by said liner is propelled along said straight line through said hollow area of said main charge;

means for detonating said shaped charge, thereby propelling a jet of liner material through said hollow area of said main charge; and means for detonating said main charge at a suitable delay time after detonation of said shaped-charge, said delay time being such as to allow said jet to enter the water and create a cavity behind it through which some of the force of the main-charge explosion can be propagated, but not being long enough to allow said cavity to begin to collapse before said energy enters the cavity.

2. An explosive charge as in claim 1, wherein said means for detonating said main charge after a suitable delay time comprises a pathway of explosive inserted between and connecting the adjacent sides of the shaped-charge explosive and the main-charge explosive, the pathway being of such length as to provide the desired delay.

3. An explosive charge as in claim 1, wherein said shaped charge is spaced from said main charge.

4. An explosive charge as in claim 1, wherein said shaped and main charges are enclosed within a torpedo casing.

* * * * *